US009263835B2

(12) United States Patent
Guo

(10) Patent No.: US 9,263,835 B2
(45) Date of Patent: Feb. 16, 2016

(54) ELECTRICAL CONNECTOR HAVING BETTER ANTI-EMI PERFORMANCE

(71) Applicant: FOXCONN INTERCONNECT TECHNOLOGY LIMITED, Grand Cayman (KY)

(72) Inventor: Hui-Gang Guo, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/517,925

(22) Filed: Oct. 20, 2014

(65) Prior Publication Data

US 2015/0111401 A1 Apr. 23, 2015

(30) Foreign Application Priority Data

Oct. 18, 2013 (CN) ..... 2013 2 0643778

(51) Int. Cl.

| | |
|---|---|
| ***H01R 4/66*** | (2006.01) |
| ***H01R 13/6596*** | (2011.01) |
| ***H01R 13/6594*** | (2011.01) |
| *H01R 12/70* | (2011.01) |
| *H01R 13/11* | (2006.01) |

(52) U.S. Cl.

CPC ..... *H01R 13/6596* (2013.01); *H01R 13/6594* (2013.01); *H01R 12/707* (2013.01); *H01R 13/112* (2013.01)

(58) Field of Classification Search

CPC ..... H01R 23/688; H01R 13/65802

USPC ..... 439/108, 607.01, 95, 96, 188, 507, 514, 439/751

See application file for complete search history.

(56) References Cited

U.S. PATENT DOCUMENTS

| | | | | |
|---|---|---|---|---|
| 5,256,074 | A * | 10/1993 | Tan et al. | H01R 13/6485 439/108 |
| 5,975,957 | A * | 11/1999 | Noda et al. | H01R 13/65802 439/607.17 |
| 6,078,504 | A * | 6/2000 | Miles | G06F 1/184 174/17 CT |
| 6,220,896 | B1 | 4/2001 | Bertoncini et al. | |
| 2008/0096423 | A1 * | 4/2008 | Huang | H01R 12/716 439/607.05 |

FOREIGN PATENT DOCUMENTS

| | | |
|---|---|---|
| CN | 102593661 | 7/2012 |
| TW | M367498 | 10/2009 |

* cited by examiner

*Primary Examiner* — Phuongchi T Nguyen

(74) *Attorney, Agent, or Firm* — Wei Te Chung; Ming Chieh Chang

(57) ABSTRACT

An electrical connector includes an insulative housing defining a rear wall and a mating cavity running through a front end of the insulative housing from the rear wall, the rear wall defines an inner surface facing the mating cavity. A plurality of conductive terminals are fixed in the insulative housing and include a plurality of grounding terminals, each conductive terminal defines a body portion and a first contacting arm extending into the mating cavity. And a grounding plate is disposed in the rear wall and defines a plurality of contacting portions running through the inner surface and extending into the mating cavity and a plurality of connecting portions connecting to the respective body portions of the grounding terminals.

18 Claims, 5 Drawing Sheets

ELECTRICAL CONNECTOR HAVING BETTER ANTI-EMI PERFORMANCE

BACKGROUND OF THE INVENTION

1. Field of the Invention

The present invention relates to an electrical connector, and more particularly to an electrical connector having a grounding plate with better anti-EMI performance, and related to the copending application Ser. No. 14/477,890 filed on Sep. 5, 2014.

2. Description of the Related Art

Taiwan Utility Pat. No. M367498 issued on Nov. 21, 2009, discloses an electrical connector including an insulative housing, a plurality of ESATA terminals, a plurality of USB terminals and a grounding plate. The insulative housing defines a mating cavity extending forwardly and a tongue portion extending into the mating cavity along a first direction, the tongue portion defines a first surface and a second surface opposite to each other. The ESATA terminal defines a contacting portion located on the first surface of the tongue portion and the USB terminal defines a contacting portion located on the second surface of the tongue portion, the grounding plated is disposed between the first and second surfaces and spaced by the tongue portion so as to not contact with the ESATA terminals or the USB terminals which effectively prevents electromagnetic interference of the terminals. However, with the development of demand for high-frequency transmission, the signal interference between the terminals is becoming increasingly serious.

Therefore, an improved electrical connector is highly desired to meet overcome the requirement.

BRIEF SUMMARY OF THE INVENTION

An object of the present invention is to provide an electrical connector selectively adjusting the overlapping position of the grounding plate and the grounding terminals.

In order to achieve above-mentioned object, an electrical connector includes an insulative housing defining a rear wall and a mating cavity running through a front end of the insulative housing from the rear wall, the rear wall defines an inner surface facing the mating cavity. A plurality of conductive terminals are fixed in the insulative housing and include a plurality of grounding terminals, each conductive terminal defines a body portion and a first contacting arm extending into the mating cavity. And a grounding plate is disposed in the rear wall and defines a plurality of contacting portions running through the inner surface and extending into the mating cavity and a plurality of connecting portions connecting to the respective body portions of the grounding terminals.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
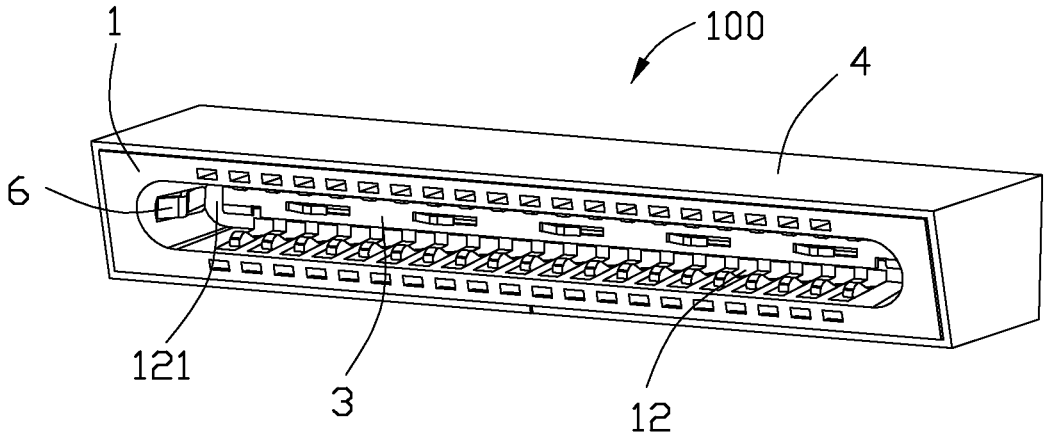
FIG. 1 is a perspective view showing an electrical connector in accordance with the present invention.
Figure 2:
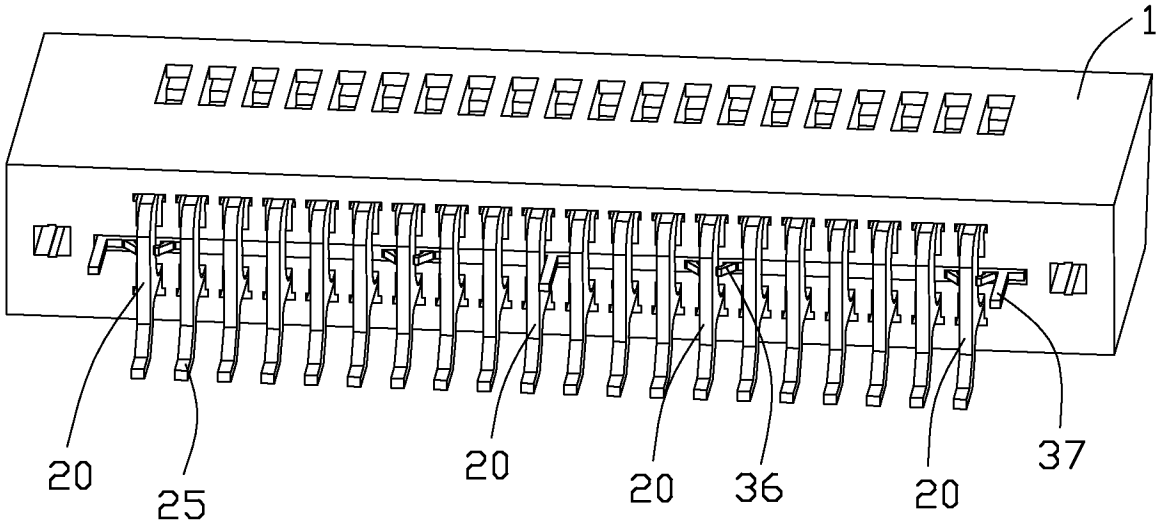
FIG. 2 is another perspective view of the electrical connector without a shielding shell shown in FIG. 1.

Reference will now be made to the drawing figures to describe a preferred embodiment of the present invention in detail. Referring to FIG. 1 and FIG. 2, an electrical connector 100 for use with a complementary connector as shown in the related copending application Ser. No. 14/477,890, has better anti-EMI performance and includes an insulative housing 1, a plurality of conductive terminals 2, a grounding plate 3 and a shielding shell 4. The electrical connector 100 defines a mating cavity 12 extending forwardly and the mating cavity 12 defines an inner surface 121 facing the mating cavity. The conductive terminals are projecting into the mating cavity 12 and include a plurality of grounding terminals 20 and signal terminals 25 arranged in a row, the signal terminals and the grounding terminals are arranged at intervals. A front end of the grounding plate 3 is projecting into the mating cavity 12 and the rear end of the grounding plate 3 is overlapping the grounding terminals 20, the grounding plate 3 not only achieves a good shielding effect, but also can reduce the electrical length and improve the resonance frequency which is contribute to the transmission of high frequency signals.

Figure 3:
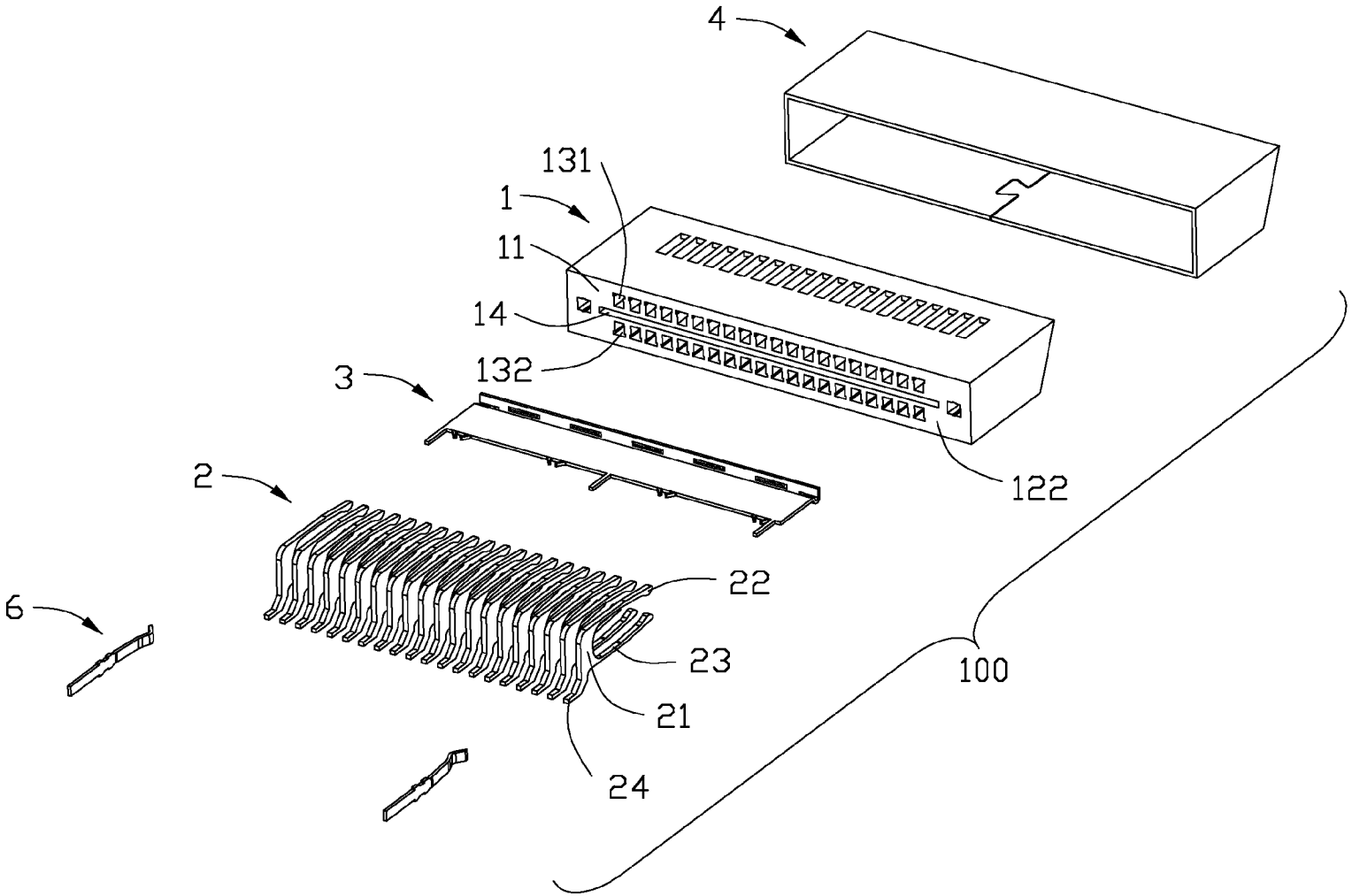
FIG. 3 is an exploded perspective view of the electrical connector shown in FIG. 1.
Figure 4:
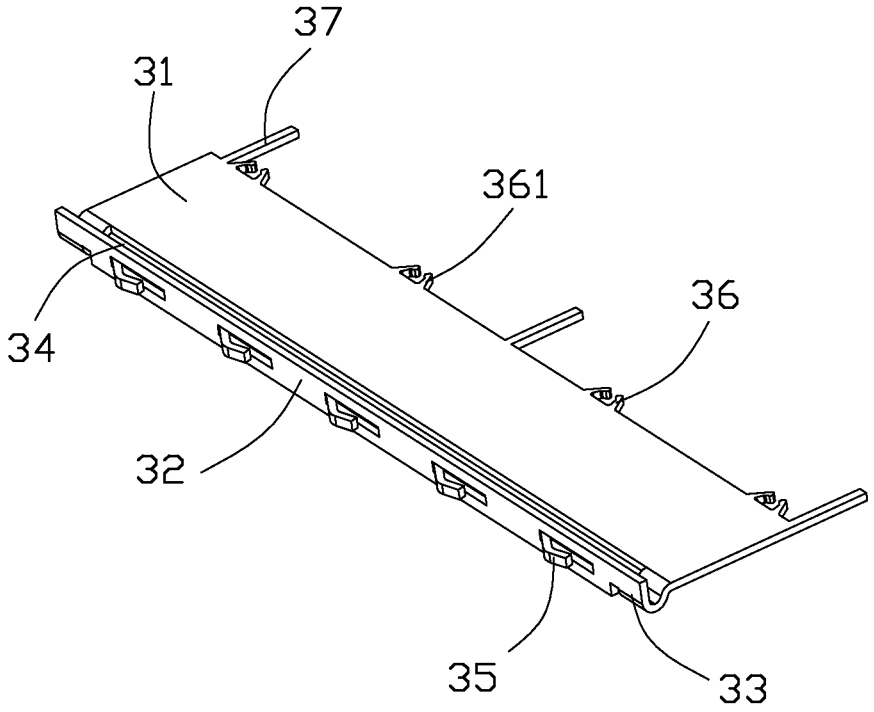
FIG. 4 is a perspective view of a grounding plate of the electrical connector shown in FIG. 1.
Figure 5:
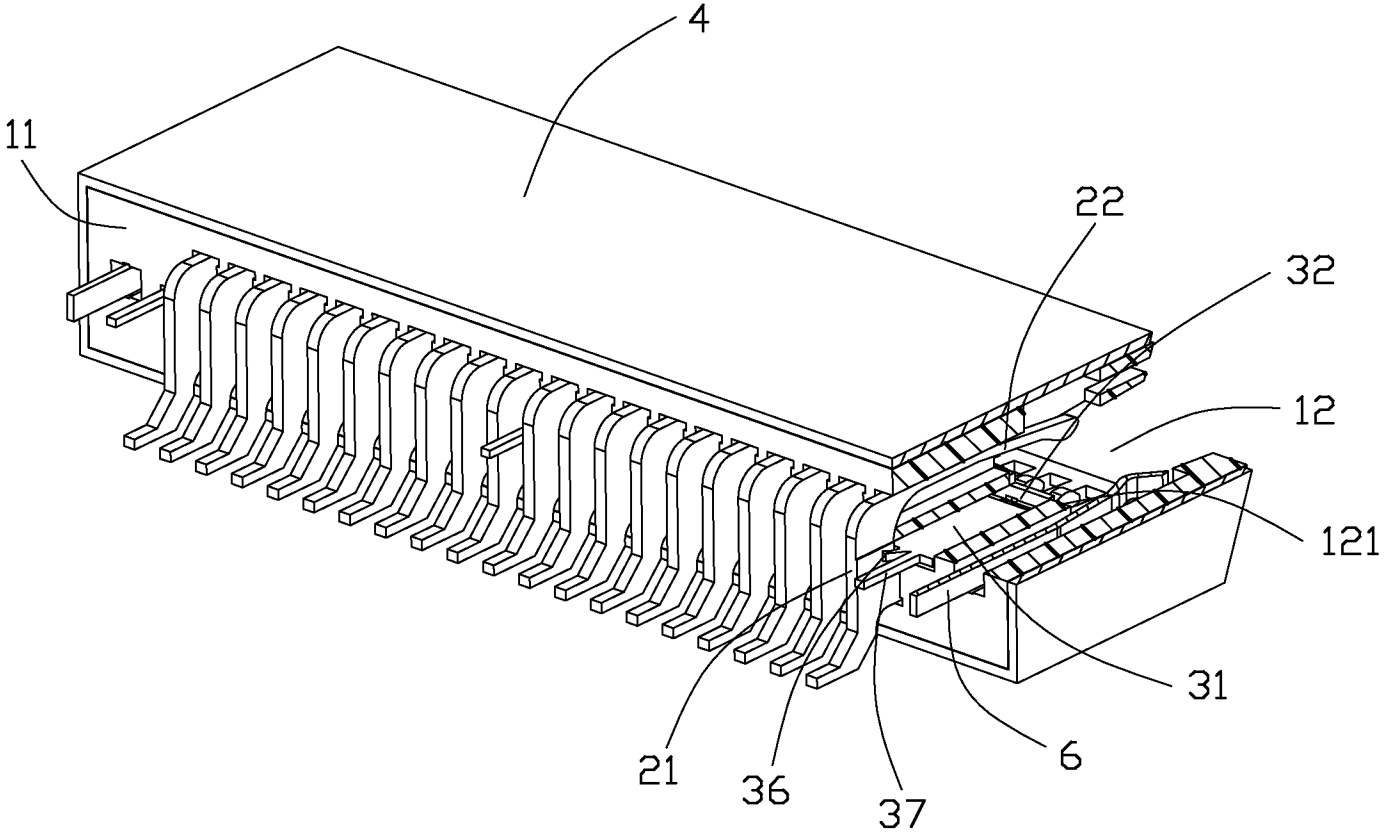
FIG. 5 is another perspective view of the electrical connector removing a portion thereof shown in FIG. 1.

Referring to FIG. 3 to FIG. 5, the insulative housing 1 is substantially a hexahedron and includes a rear wall 11 and the mating cavity 12 running through the insulative housing 1, the inner surface 121 of the mating cavity 12 is the front surface of the rear wall 11. The insulative housing 1 defines a plurality of terminal slots 131, 132 located on the corresponding upper and lower sidewalls and a through groove 14 running through the front surface and the rear surface 122 of the rear wall 11. This embodiment is a horizontally mounted electrical connector, but the rear wall is a bottom wall in a vertically mounted electrical connector so that the rear wall has a wide meaning.

The conductive terminals 2 are fixed vertically in the insulative housing 1 and each includes a vertical body portion 21, a soldering portion 24 extending out of the insulative housing 1, an elastic first contacting arm 22 and an elastic second contacting arm 23 extending into the mating cavity 12. The first contacting arm 22 and the second contacting arm 23 are respectively extending from the upper and lower ends of the body portion 21, and the soldering portion 24 is located below the second contacting arm 23. The first and second contacting arms are respectively inserted into the terminal slots 131, 132 from the rear surface 122 of the rear wall 11 until the first and second contacting arms slightly inclined extend into the mating cavity 12, the front end of the body portion 21 is fixed in the rear wall 11 and the rear end of the body portion 21 is projecting out of the rear surface 122 of the rear wall 11 and exposed to the air.

The grounding plate 3 is a L-shaped and disposed in the rear wall 11. The grounding plate 3 includes a flat portion 31 disposed within the through groove 14, a vertical portion 32 bending from the flat portion 31 and attached to the inner surface 121 and two bending portions 33 formed between the flat portion 31 and the vertical portion 32, two bending portions 33 are respectively connecting with the both ends of the flat portion 31 and the vertical portion 32 in a longitudinal direction. The flat portion 31, the vertical portion 32 and two bending portions 33 of the grounding plate are together formed a lengthwise cutout portion 34, the cutout portion 34 is embedded in the insulative housing 1 and used for giving way to the die when the vertical portion 32 is stamping molding.

The grounding plate 3 further includes a plurality of contacting portions 35 running through the inner surface 121 of the mating cavity 12 and extending into the mating cavity 12 and a plurality of connecting portions 36 overlapping to the body portion 21 of the grounding terminals, the contacting portions 35 are a plurality of tabs formed by stamped forwardly from the vertical portion 32, and the connecting portions 36 are a plurality of elastic clamping pieces extending from rear edge of the flat portion 31. The contacting portions 35 are arranged in a row in the longitudinal direction and extending in a same direction, the flat portion 31 and the vertical portion 32 of the grounding plate 3 are connected together by the bending portions located both ends thereof, and the top of the vertical portion 32 is higher than the flat portion 31. The connecting portion 36 is projecting out of the rear surface of the insulative housing 1 and clamping the grounding terminal of the body portion 21. The elastic clamping pieces 36 extend from the rear end of the ground plate 3 and close to the middle from coarse to fine, the end of each elastic clamping piece 36 defines a hook 361 which can effectively fixed corresponding ground terminal 20 so that the grounding path is shorter and has better effect of anti-EMI. Moreover, according to different needs at different ground terminals and signal terminals are arranged, we can adjust the position of the connecting portions 36 to overlap the grounding terminals 20, which is easy to use.

The grounding plate 3 further includes a plurality of soldering pieces 37 extending rearwardly and projecting out of the insulative housing 1, the connecting portions 36 and the soldering pieces 37 are formed by the grounding plate 3 extending rearwardly and horizontally. The electrical connector 100 further includes a pair of power terminals 6 located on both ends of the mating cavity 12 and perpendicular to the grounding terminals. The shielding shell is frame structure and surrounding the outside of the insulative housing 1.

In summary, the grounding plate 3 can be adjusted the position of the connecting portions 36 to overlap the grounding terminals 20, which is easy to use, so that the grounding path is shorter and has better effect of anti-EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing defining a rear wall and a mating cavity running through a front end of the insulative housing from the rear wall, the rear wall defining an inner surface facing the mating cavity;

a plurality of conductive terminals fixed in the insulative housing and including a plurality of grounding terminals, each conductive terminal defining a body portion and a first contacting arm extending into the mating cavity; and a grounding plate disposed in the rear wall; wherein the grounding plate defines a plurality of contacting portions running through the inner surface and extending into the mating cavity and a plurality of connecting portions connecting to the respective body portions of the grounding terminals; wherein the rear wall defines a through groove running through the inner surface and the rear end of the rear wall, the grounding plate defines a flat portion disposed in the through groove and a vertical portion bending from the flat portion and attaching to the inner surface, the contacting portions are a plurality of tabs formed by stamped forwardly from the vertical portion, and each connecting portion is a pair of elastic clamping pieces extending from a rear edge of the flat portion; wherein two bending portions are formed between the flat portion and the vertical portion of the grounding plate and respectively connecting with the both ends of the flat portion and the vertical portion in a longitudinal direction, the flat portion, the vertical portion and two bending portions of the grounding plate are together formed a lengthwise cutout portion and the cutout portion is embedded in the insulative housing.

2. The electrical connector as described in claim 1, wherein the electrical connector further includes a shielding shell surrounding the outside of the insulative housing.

3. The electrical connector as described in claim 1, wherein the electrical connector further includes a pair of power terminals located on both ends of the mating cavity and perpendicular to the grounding terminals.

4. The electrical connector as described in claim 1, wherein the pair of elastic clamping pieces extend from the rear end of the ground plate and close to the middle from coarse to fine, each elastic clamping piece defines a hook at an free end thereof.

5. The electrical connector as described in claim 4, wherein the grounding plate further includes a plurality of soldering pieces extending rearwardly and projecting out of the insulative housing, the connecting portions and the soldering pieces are formed by the grounding plate extending rearwardly and horizontally.

6. The electrical connector as described in claim 5, wherein the conductive terminals are vertically fixed in the insulative housing and each defines a second contacting arm, the first and second contacting arms are respectively extending from the upper and lower ends of the body portion.

7. The electrical connector as described in claim 6, wherein the flat portion is located in the rear side of the rear surface of the rear wall, the elastic clamping pieces are projecting outside of the rear surface and clamping the respective body portions of the grounding terminals.

8. The electrical connector as described in claim 7, wherein the contacting portions are arranged in a row in the longitudinal direction and extending in a same direction, the flat portion and the vertical portion of the grounding plate are connected together by the bending portions located both ends thereof, and the top of the vertical portion is higher than the flat portion.

9. An electrical connector, comprising:

an insulative housing defining a mating cavity recessed backwardly from a front end of the insulative housing;

a plurality of conductive terminals fixed in the insulative housing, the conductive terminals defining body portions retained in the insulative housing, a set of first contacting arms protruding downwardly into the mating cavity, and a set of second contacting arms protruding upwardly into the mating cavity, the conductive terminals including a number of grounding terminals arranged at intervals and separated by a number of non-grounding terminals; and a grounding plate defining a flat portion retained in the insulative housing and located between the first and second contacting arms, a plurality of contacting portions formed at front of the flat portion and extending forwardly into the mating cavity, and a plurality of connecting portions formed at back of the flat portion and connecting to the respective body portions of the grounding terminals;

the rear wall defines a through groove running through the inner surface and the rear end of the rear wall, the grounding plate defines a flat portion disposed in the through groove and a vertical portion bending from the flat portion and attaching to the inner surface, the contacting portions are a plurality of tabs formed by stamped forwardly from the vertical portion, and each connecting portion is a pair of elastic clamping pieces extending from a rear edge of the flat portion; wherein two bending portions are formed between the flat portion and the vertical portion of the grounding plate and respectively connecting with the both ends of the flat portion and the vertical portion in a longitudinal direction, the flat portion, the vertical portion and two bending portions of the grounding plate are together formed a lengthwise cutout portion and the cutout portion is embedded in the insulative housing.

10. The electrical connector as described in claim 9, wherein the insulative housing defines a through groove recessed forwardly from a back end of the insulative housing for receiving the flat portion, the grounding plate defines a vertical portion bending from the flat portion, the connecting portions are a plurality of tabs formed by stamping forwardly from the vertical portion.

11. The electrical connector as described in claim 9, wherein each connecting portion includes a pair of elastic clamping pieces extending backwardly from the flat portion and clamping two sides of the respective body portion of the grounding terminal.

12. The electrical connector as described in claim 9, wherein each conductive terminal defines a pair of said first and second contacting arms integrally extending from said body portion.

13. An electrical connector for use with a complementary connector, comprising:

an insulative housing defining therein a mating cavity rearwardly recessed from a front face and forwardly communicating with an exterior in a front-to-back direction for receiving a mating tongue of said complementary connector, and an inner surface located at an inner side of said mating cavity and forwardly facing said mating cavity in the front-to-back direction;

a plurality of contacts disposed in the housing with contacting arms located by one side of the mating cavity and extending into the mating cavity in a vertical direction perpendicular to said front-to-back direction;

a grounding bar extending in a horizontal plane defined by said front-to-back direction and a longitudinal direction perpendicular to both said front-to-back direction and said vertical direction, said grounding bar disposed in the housing with at a front end contacting portions forwardly extending into the mating cavity in said front-to-back direction for grounding with a metallic shell of the complementary connector, and with at a rear end connecting portions respectively mechanically and electrically connected to the selected contacts;

the rear wall defines a through groove running through the inner surface and the rear end of the rear wall, the grounding plate defines a flat portion disposed in the through groove and a vertical portion bending from the flat portion and attaching to the inner surface, the contacting portions are a plurality of tabs formed by stamped forwardly from the vertical portion, and each connecting portion is a pair of elastic clamping pieces extending from a rear edge of the flat portion; wherein two bending portions are formed between the flat portion and the vertical portion of the grounding plate and respectively connecting with the both ends of the flat portion and the vertical portion in a longitudinal direction, the flat portion, the vertical portion and two bending portions of the grounding plate are together formed a lengthwise cutout portion and the cutout portion is embedded in the insulative housing.

14. The electrical connector as claimed in claim 13, wherein said connecting portion is deflectable in the longitudinal direction.

15. The electrical connector as claimed in claim 13, wherein said grounding bar further includes a plurality of soldering legs at the rear end.

16. The electrical connector as claimed in claim 13, wherein said contacting portion is resilient to be deflectable in the front-to-back direction.

17. The electrical connector as claimed in claim 16, wherein said grounding bar includes a front section extending in a plane angled to said horizontal plane, and the contacting portions extend from said front section.

18. The electrical connector as claimed in claim 16, wherein said front section defines a thickness direction same with said front-to-back direction.

* * * * *